United States Patent [19]

Pawlik et al.

[11] 4,185,708

[45] Jan. 29, 1980

[54] BIT FOR DRILLING HOLES IN ROCKS

[75] Inventors: Kazimierz Pawlik; Jadwiga Janikowska-Pawlik; Adam Siedlar, all of Cracow, Poland

[73] Assignee: Akademia Gorniczo-Hunicza im, Stanislawa Staszica, Cracow, Poland

[21] Appl. No.: 814,117

[22] Filed: Jul. 3, 1977

[30] Foreign Application Priority Data

Aug. 31, 1976 [PL] Poland ..... 192149

[51] Int. Cl.[2] ..... E21C 13/00

[52] U.S. Cl. ..... 175/410; 175/419

[58] Field of Search ..... 175/410, 415, 419

[56] References Cited

U.S. PATENT DOCUMENTS

| | | | |
|---|---|---|---|
| 2,101,376 | 12/1937 | Voigtander | 175/410 |
| 2,494,188 | 1/1950 | Meaney | 175/410 X |
| 2,650,071 | 8/1953 | Rassieur | 175/410 |
| 3,140,749 | 7/1964 | Dionisotti | 175/410 |
| 4,026,372 | 5/1977 | Hampson | 175/410 |

*Primary Examiner*—James A. Leppink
*Assistant Examiner*—Richard E. Favreau
*Attorney, Agent, or Firm*—Haseltine, Lake & Waters

[57] ABSTRACT

A bit for drilling holes in rocks comprising inserts of sintered carbide, the base of which in a plane perpendicular to the edge of its drill point follows a downward convex curve along the symmetry axis of the cross-section of the insert. The insert has the shape of an quadrangle in a section perpendicular to the cross-section of the insert, the side situated nearest to the axis of the bit being inclined at an acute angle $\phi$, and the side corresponding to the base of the insert being inclined thereto at an angle $\epsilon$ determined by the relationship $90° > \epsilon \geqq 90° - \phi$, wherein $\phi < 30°$. The plane of symmetry of the insert, taken perpendicular to the cross-section of the bit is inclined at an angle $\tau$ determined by the relationship $90° \leqq \tau \leqq 90° + \gamma$, wherein $\gamma$ is the angle of incidence of the drill point of the bit.

3 Claims, 4 Drawing Figures

BIT FOR DRILLING HOLES IN ROCKS

FIELD OF THE INVENTION

This invention relates to a bit for drilling holes in moderately and hard gettable rocks.

BACKGROUND

A known drilling bit for holes in rocks comprises a shank made as a single workpiece with extension serving as a bit head with inserts of sintered carbide mounted therein by means of soldering. The parts of the inserts protruding above the head constitute the drill points of the bit, arranged symmetrically on the front face thereof and together with a part of the head are shaped in the form of a wedge having equal angles in relation to a plane passing through the drill point edge of the bit and parallel to the main axis of the bit. The side surfaces of the bit are parallel to each other and perpendicular to the cross-section of the bit, whereby the basic surface of the insert is perpendicular to the side surfaces of the bit. Between the drill points, in the main axis of the bit, a central flushing channel is provided, and between the drill points, in the side surface of the bit, pockets are made, to remove the drillings material. Said pockets are connected above the flushing channels with the cylindrical space of the shank. Moreover, the cross-section of the part of the insert, situated below the drill point, lying in the plane of symmetry of said part of the insert, perpendicular to the cross-sectional plane thereof, has the form of an irregular quadrangle.

A disadvantage of said bit consists in the frequent spalling of the drill points and breaking of the sintered carbide inserts in the course of drilling holes in rock, caused by occurrence of high stress concentrations in the corners of the plate bases. Furthermore, the rock core formed in the central part of the hole being drilled causes a shearing of the solder and pushing the plates outside the bit head.

SUMMARY OF THE INVENTION

An object of the invention is to increase the overall strength of the bit, and this is achieved by the choice of the geometrical parameters of the inserts of sintered carbides preventing the inserts from being pushed outside the bit head.

The invention essentially comprises a bit for drilling holes in rocks, wherein the profile of the base of the insert of sintered carbide is along a downward convex curve symmetrical with the symmetry axis of the cross-section of the insert. In the irregular quadrangle, however, resulting from the section of the insert with the symmetry plane of the insert, the side situated nearest to the bit axis is inclined thereto at an acute angle $\phi$ and the side corresponding to the base of the insert is inclined thereto at an angle $\epsilon$ determined by the relationship $90° > \epsilon \geqq 90° - \phi$, wherein $\phi < 30°$. Moreover, the symmetry plane of the insert situated below the drill point and perpendicular to its cross-sectional plane is inclined with the cross-section of the bit at an angle $\tau$ determined by the relationship $90° \leqq \tau \leqq 90° + \gamma$, wherein $\gamma$ is the angle of incidence of the bit drill point.

The advantage of the rock drilling bit according to the invention consists in uniform distribution of pressures over the entire base surfaces of the sintered carbide plates. The forces pressing the bit against the face of the rock to be drilled equalize further the values of forces shearing the solder, effected by the core being formed in the central part of the hole being drilled.

BRIEF DESCRIPTION OF THE DRAWINGS

The rock drilling bit according to the invention is diagrammatically presented in an exemplary embodiment.

DETAILED DESCRIPTION

Figure 1:
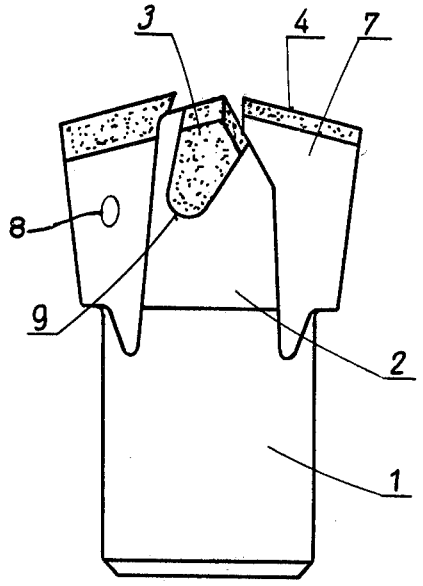
FIG. 1 is a side view of the bit.
Figure 3:
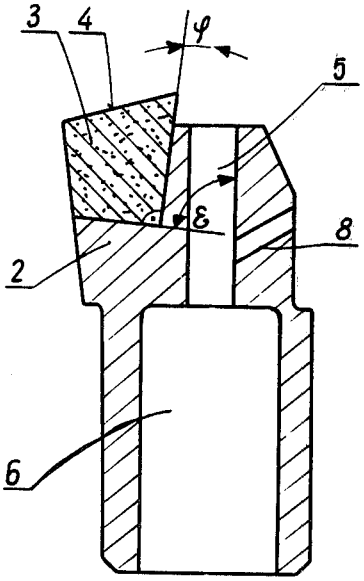
FIG. 3 is a longitudinal sectional view of the bit, taken along line 3—3 in FIG. 2.
Figure 2:
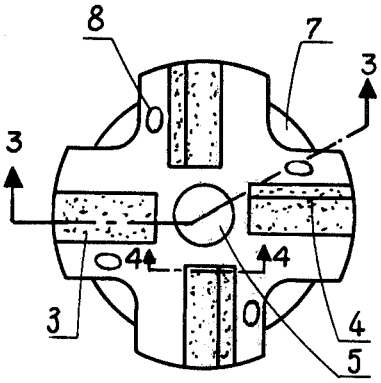
FIG. 2 is a top plan view of the bit.
Figure 4:
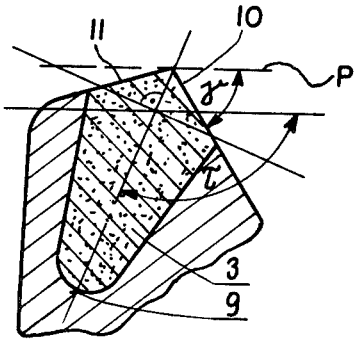
FIG. 4 is an enlarged sectional view taken along line 4—4 in FIG. 2.

The subject of the invention comprises a drill bit having a cylindrical shank 1 made as a one piece body having an extension forming the head 2 of the bit with inserts 3 made of sintered carbide mounted therein. The inserts 3 are connected to the head 2 by means of solder. The parts of the inserts 3, protruding above the head 2, constitute drill points 4 of the bit, distributed symmetrically on the front face of the bit. Between the drill points 4, in the main axis of the bit, a central flushing channel 5 is provided, connected with a cylindrical space 6 in the shank 1, whereas between the inserts 3, in the side surface of the head, pockets 7 are formed for removing the drillings material, via flushing channels 8 connected with the central flushing channel 5. The cross-section of the insert part 3 situated below the drill point 4, taken with respect to the symmetry plane of this part of the insert 3, perpendicular to its cross-section, has the form of an irregular quadrangle (FIG. 3). The profile of the base of insert 3 follows a downward convex curve 9 even against the symmetry axis of the cross-section of the insert 3. In the irregular quadrangle, however, resulting from the section of the insert 3 with the symmetry plane of the part of insert 3, situated below the drill point 4 and perpendicular to the cross-section of the insert 3, the side situated nearest to the axis of the bit is inclined thereto at an acute angle $\phi$ equal to 12°, and the side corresponding with the insert base is inclined thereto at an angle $\epsilon$ equal to 78°. Moreover, the symmetry plane of the part of insert 3, situated below the drill point 4, perpendicular to its cross-sectional plane is inclined with the cross-section of the bit at an angle $\leqq$ determined according to the relationship $90° \leqq \tau \leqq 90° + \gamma$ wherein $\gamma$ is the angle of incidence of the bit drill point 4. In particular, as shown in FIG. 4 the insert 4 has inclined upper faces 10 and 11 which intersect at edge or drill point 4 and the angle of incidence $\gamma$ is formed between face 10 (referred to as the "face plane") and plane P extending perpendicular to the longitudinal axis of the bit.

What is claimed is:

1. A bit for drilling holes in rocks comprising a cylindrical shank with an integral extension constituting a bit head, and a plurality of inserts of sintered carbide secured in said extension and distributed symmetrically around the axis of said cylindrical shank, said inserts projecting axially beyond said bit head to constitute drill points situated symmetrically with respect to said axis of the cylindrical shank, said inserts each having the shape of an irregular quadrangle in a longitudinal plane passing through said insert, said inserts each having a profiled shape with a convex bottom portion in a transverse plane perpendicular to said longitudinal plane, the profiled shape of each insert in said transverse plane including upper inclined faces intersecting along an edge forming the drill point one of which faces constitutes a face plane inclined at an angle of incidence $\gamma$ with respect to a plane extending perpendicular to the axis of the shank, said quandrangle having an inner side closest to said axis of the shank which is inclined thereto at an acute angle $\phi$, and a lower base inclined with respect to said axis of the shank at an angle $\epsilon$ satisfying the relation $90° > \epsilon > 90° - \phi$, said profile shape of the bit having an axis of symmetry angularly offset with respect to a plane perpendicular to said axis of said cylindrical shank at an angle $\tau$ satisfying the relation $90° \geqq \tau \leqq 90° + \gamma$.

2. A bit as claimed in claim 1 wherein said profiled shape of the bit tapers in narrowing fashion from said inclined faces towards said convex bottom portion.

3. A bit as claimed in claim 1 wherein said shank has a cylindrical channel, said bit head having a central flushing channel communicating with said cylindrical channel, said bit head being provided with pockets between adjacent inserts, and with flushing channels extending from said central flushing channel into said pockets.

* * * * *